US006055836A

United States Patent [19]

Waterworth et al.

[11] Patent Number: 6,055,836

[45] Date of Patent: May 2, 2000

[54] FLANGE REFORMING APPARATUS

[75] Inventors: Miles Waterworth, Leeds; Frederick William Jowitt, Bingley, both of United Kingdom

[73] Assignee: Crown Cork & Seal Technologies Corporation, Alsip, Ill.

[21] Appl. No.: 09/227,741

[22] Filed: Jan. 8, 1999

[30] Foreign Application Priority Data

Jan. 17, 1998 [GB] United Kingdom ..... 9800937

[51] Int. Cl.[7] ..... B21D 19/12

[52] U.S. Cl. ..... 72/110; 72/94

[58] Field of Search ..... 72/84, 86, 87, 72/94, 110, 124, 126; 413/31

[56] References Cited

U.S. PATENT DOCUMENTS 2,534,220 12/1950 Birkland ..... 72/94
3,581,542 6/1971 Wahler et al. ..... 72/94
4,747,287 5/1988 Azzaline et al. ..... 72/126
5,069,052 12/1991 Porucznik et al. ..... 72/84

*Primary Examiner*—Lowell A. Larson
*Attorney, Agent, or Firm*—Diller, Ramik & Wight, PC

[57] ABSTRACT

Apparatus for re-forming a seaming flange (F) formed on the open end of a can body (B) comprises: a bottom support for supporting the bottom end wall of the can body and a pusher pad (2) including a circular disc (12) having an outer profile adapted to receive and support the open end of the can body with the seaming flange protruding radially outwardly beyond the disc. A push rod (4) moves the pusher pad axially towards and away from the bottom support such that successive can bodies can be held there between whilst the pusher pad and bottom support are driven in rotation about their common axis. One or more rollers (34) are mounted adjacent the outer edge of the pusher pad disc for axial movement with the push rod and the pusher pad (2) is mounted on the push rod (4) for limited axial movement thereon against the action of a spring (38). The arrangement is such that during this limited axial movement of the pusher pad (2) on the push rod (4), the seaming flange on the open end of the can body engages the rollers (34) and is re-formed thereby.

15 Claims, 3 Drawing Sheets

FLANGE REFORMING APPARATUS

BACKGROUND OF THE INVENTION

The invention relates to apparatus for reforming a seaming flange on the open end of a can body.

Can bodies are conventionally formed with a seaming flange for connection to the seaming curl of a can end after the can has been filled. Apparatus for forming such a flange is known, for example, from EP-A-113248. Conventionally, the flange lies substantially perpendicular to the axis of the can body or may be inclined slightly upwardly and outwardly. Such flanges are conventionally described as having a positive flange angle.

It has also been suggested, in WO 96/31302 that a can might usefully be provided with a downturned flange that is one having a negative flange angle.

SUMMARY OF THE INVENTION

The purpose of the present invention is to provide apparatus for re-forming the seaming flange of a can body such that, for example, a flange having positive or zero flange angle can be reformed to have a reduced or negative flange angle.

According to the present invention there is provided apparatus for re-forming a seaming flange on the open end of a can body comprising: means for supporting the can body and for driving it in rotation about its axis; at least one roller mounted for free rotation about an axis inclined to the axis of the can body; and means for moving the roller or rollers into engagement with the seaming flange as the can body is rotated to re-form it.

An embodiment of the invention is described below with reference to the accompanying drawings, in which:

DESCRIPTION OF THE PREFERRED EMBODIMENTS

Figure 1:
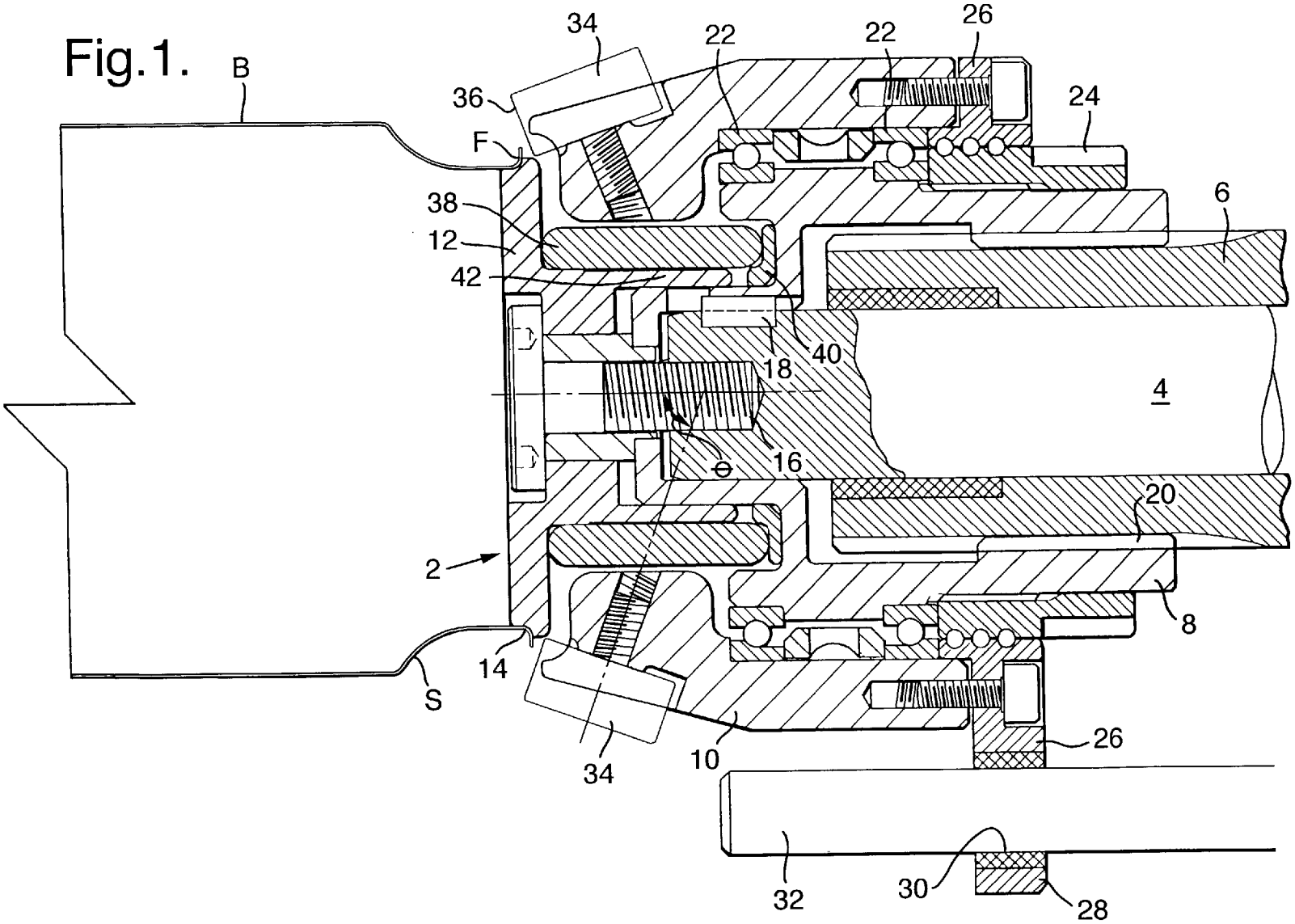
FIG. 1 is a sectional view showing the flange reforming head assembly of the apparatus.

FIG. 1 shows the flange re-forming head assembly which is the part of the apparatus which engages the flanged end of the can body B and consists generally of a pusher pad 2, a push rod 4, a pusher spindle 6, a drive flange 8 and a sleeve 10 coupled together as described below and all being co-axial with one another and with the can body.

The pusher pad 2 includes a circular disc 12 which has an outer profile 14 which is adapted to receive and support the open end of the can body with the seaming flange F protruding radially outwardly beyond the disc. The pusher pad 2 is carried on the drive flange which in turn is fixed to the push rod 4 by means of a bolt 16 and a key 18. The push rod is axially slidable with the pusher spindle which is driven in rotation by the machine drive. The drive flange 8 is coupled in rotation to the pusher spindle 6 by means of co-operating splines 20 which allow relative axial sliding movement between the two components. The sleeve 10 is mounted on the drive flange through annular bearings 22 held in position by a nut 24 screwed onto the drive flange and a ring 26 bolted to the sleeve 10. An arm 28 extending radially outwardly from the ring 26 has a bore 30 therethrough which slides on a guide post 32.

It will be understood from this arrangement that the sleeve 10 is mounted for axial movement with the push rod but is held against rotation. The sleeve carries one or more forming rollers 34 which are mounted for free rotation about their axes which are inclined at an angle θ to the axis of the pusher pad and have plain cylindrical forming surfaces 36. As shown, the angle θ is an acute angle of about 70° but it may be of greater or lesser size.

Rollers having profiled surfaces may also be used. The profiled flange forming surface may be curved and/or angular. When the forming surface includes an angular profile, that surface may have two or more parts. The or each part of the forming surface may be at an angle to the axis of the pusher pad, typically in addition to the axis of the roll itself being inclined at angle θ to the axis of the pusher pad. An angle on the profiled roller is able to act like a groove to prevent material from flaring out as the flange is formed.

The shape of a profiled roller may be selected to avoid lacquer peel. The decoration on a can is sometimes less resilient to a flat roller so a convex curved profile, for example, may be used instead.

A profiled roller having two or more parts may also be used to commence formation of a first operation seam.

The pusher pad 2 is mounted on the drive flange 8 for rotation therewith and for limited axial movement thereon. The pusher pad is normally biased into the forward position shown in FIG. 1 by means of a spring 38 acting between the disc 12 and a spacer stop 40 fitted to the drive flange. The extent of available relative axial movement is determined by the gap between the free end of a mounting sleeve 42 of the pusher pad and the spacer stop 40.

In the described embodiment, the flange reforming head assembly provides the pusher pad assembly of apparatus for re-forming the base profile of the can body and replaces the conventional plain flat pusher pad assembly. Other parts of this apparatus which are mostly conventional are shown in FIGS. 2 and 3 and are briefly described below.

Figure 2:
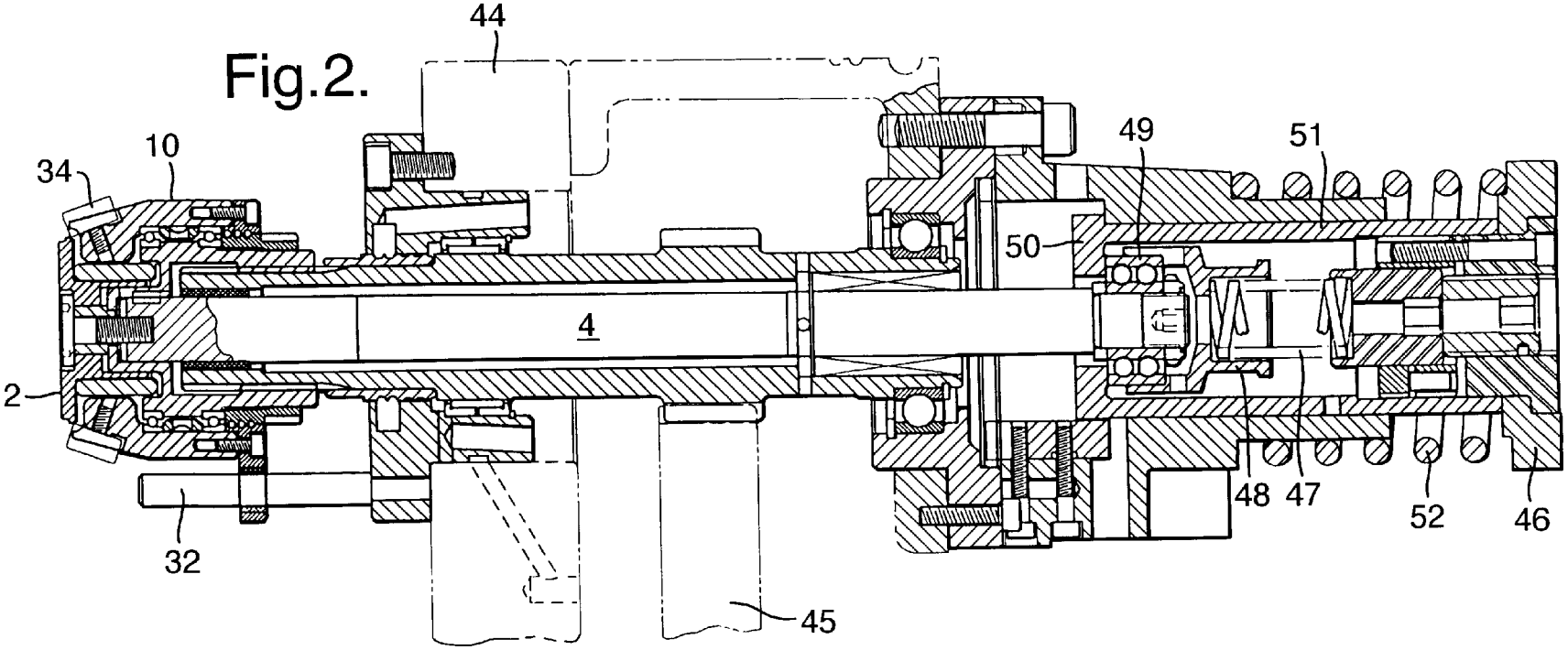
FIG. 2 is a sectional view showing the pusher side of apparatus.

FIG. 2 shows the pusher side of the apparatus mounted on a rotary turret 44 shown partially in phantom. The drive connection 45 to the pusher spindle is also shown in phantom. The end of the push rod 4 remote from the pusher pad 2 is connected to an end piece 46 through a compliance spring 47, a sleeve 48 and a bearing 49, the spring 47 normally biasing the bearing 49 into the position shown in FIG. 2 where it abuts a flange 50 on the end of an outer sleeve 51 which is also coupled to the end piece 46. As the turret rotates, a cam operated yoke (not shown) bears on the end face of the end piece 46 to push the rod 4 axially against the action of a return spring 52.

Figure 3:
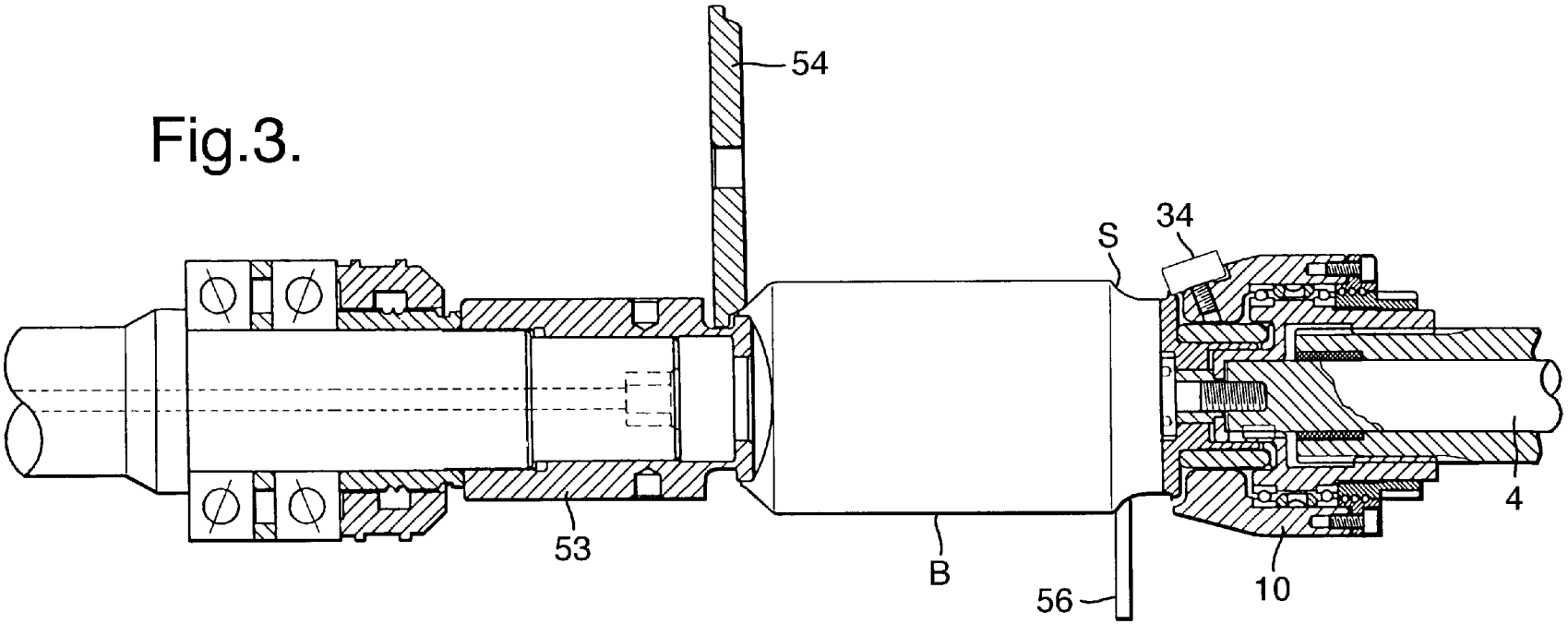
FIG. 3 is a sectional view showing the head assembly and base profile reforming parts of the apparatus.

On the other side of the apparatus, as shown in FIG. 3, a base reforming tool is mounted on a second parallel turret (not shown). The base reforming tool includes a chuck 53 and a forming roll 54. A discharge stripper 56 is also shown in FIG. 3.

Operation of the apparatus is as follows. As the turrets rotate, can bodies are sequentially fed into position between the base reforming tool and the head assembly and are held by half-moulds (not shown). The push rod 4 is then advanced so that the open end of the can body is engaged by the pusher pad 2 and the base of the can body is pushed into contact with the base reforming chuck 53. At this time, the can body is being driven in rotation through the pusher pad 2 and the forming roll 54 can be moved into the position shown in FIG. 3 to reform the base profile of the can body.

Once the base of the can has engaged the chuck 53, further movement of the can body is prevented. The push rod 4 continues to advance, however, causing the pusher pad 2 to retract thereon against the action of spring 38. During this travel of the pusher pad 2, the rollers 34 engage the flange F of the can body and reform it. The rollers 34 engage the flange F over a very small area but because of the rotation of the can body, the rollers are able gently to re-form the flange in an even manner.

Where profiled rollers are used, the profile can prevent material from flowing outwardly as the flange is formed. The profile is selected so that flange will rest gently against part of the profile. This reduces can damage by reducing or preventing scuffing which may occur when the outside diameter is allowed to increase freely as with plain rollers.

Once the mounting sleeve 42 of the pusher pad 2 engages the spacer stop 40, any further advance of the push rod 4 is prevented and further advance of the end piece is absorbed by the compliance spring.

When the re-forming of the base and flange is completed, the push rod 4 retracts and the can body is released to be conveyed from the apparatus. A discharge stripper guide 56 is brought into engagement with the shoulder 5 of the can body to strip the can body from the flange reforming head assembly as the push rod 4 retracts.

Whilst the invention has been described as forming part of apparatus which also re-forms the base profile of can bodies, it should be understood that the invention might be provided as a separate station at which the can body is supported by a simple pusher at the base of the can body or possibly by a side wall support.

Although a preferred embodiment of the invention has been specifically illustrated and described herein, it is to be understood that minor variations may be made in the apparatus without departing from the spirit and scope of the invention, as defined the appended claims.

What is claimed is:

1. Apparatus for re-forming a seaming flange formed on the open end of a can body comprising:

a bottom support for supporting the bottom end wall of the can body;

a pusher pad including a circular disc having an outer profile adapted to receive and support the open end of the can body with the seaming flange protruding radially outwardly beyond the disc;

a push rod for moving the pusher pad axially towards and away from the bottom support such that successive can bodies can be held therebetween;

means for driving the pusher pad in rotation about its axis;

at least one roller mounted adjacent the outer edge of the pusher pad disc for rotation about an axis inclined to the axis of the pusher pad and mounted for axial movement with the push rod; and the pusher pad being mounted on the push rod for limited axial movement thereon against the action of a spring whereby during such limited axial movement the seaming flange on the open end of the can body engages the at least one roller and is re-formed thereby.

2. Apparatus according to claim 1, in which a plurality of rollers are provided and are mounted on a sleeve which is itself mounted on the push rod for axial movement therewith but held against rotation therewith.

3. Apparatus according to claim 2, in which the push rod is mounted slidably within a pusher spindle and in which a drive flange splined onto the pusher spindle is keyed to the push rod such that the push rod, pusher spindle and drive flange are coupled together for rotation.

4. Apparatus according to claim 3, in which the sleeve is mounted on the drive flange through an annular bearing and is held against rotation with the drive flange by means of a sliding connection to a stationary guide post.

5. Apparatus according to claim 4, in which the pusher pad is axially slidably mounted on the drive flange.

6. Apparatus according to claim 1, in which the at least one roller is profiled.

7. Apparatus according to claim 1, in which the pusher pad is the pusher pad of apparatus for reforming the base profile of a can body.

8. Apparatus according to claim 1, further comprising a stripping member which can be moved to a position in which it engages a shoulder on the can body to strip the can body from the apparatus after the seaming flange has been re-formed.

9. Apparatus for re-forming a seaming flange formed at an open end of a can body comprising means for supporting a can body, a pusher pad including a circular pusher pad disc having an outer profile adapted to internally support the open end of a can body with a seaming flange of the can body protruding radially outwardly beyond the pusher pad disc, a push rod for moving the pusher pad axially into and out of the can body open end, means for rotating the pusher pad about an axis thereof, at least one roller adjacent an outer edge of the pusher pad disc, said at least one roller having an axis of rotation inclined to the pusher pad axis, and said at least one roller being carried by said push rod and being movable axially therewith whereby the seaming flange of the can body is engaged by the at least one roller and is reformed thereby.

10. The apparatus as defined in claim 9 including means for mounting the pusher pad and the push rod for limited axial movement therebetween.

11. The apparatus as defined in claim 10 including spring means for biasing said pusher pad and said at least one roller axially away from each other.

12. The apparatus as defined in claim 9 wherein the at least one roller is mounted on a sleeve, and said sleeve is mounted for axial movement relative to said push rod.

13. The apparatus as defined in claim 12 including spring means for biasing said pusher pad and said at least one roller axially away from each other.

14. The apparatus as defined in claim 9 wherein the at least one roller is mounted on a sleeve, said sleeve is mounted for axial movement relative to said push rod, and means for substantially preventing rotation between said sleeve and push rod.

15. The apparatus as defined in claim 14 including spring means for biasing said pusher pad and said at least one roller axially away from each other.

* * * * *